US008714773B2

(12) United States Patent
Low et al.

(10) Patent No.: US 8,714,773 B2
(45) Date of Patent: May 6, 2014

(54) LED LIGHTING DEVICE WITH UNIFORM COLOR MIXING

(75) Inventors: Tek Beng Low, Melaka (MY); Eng Wah Tan, Melaka (MY)

(73) Assignee: Dominant Opto Technologies SDN. Bhd., Melaka (MY)

( * ) Notice: Subject to any disclaimer, the term of this patent is extended or adjusted under 35 U.S.C. 154(b) by 0 days.

(21) Appl. No.: 13/113,707

(22) Filed: May 23, 2011

(65) Prior Publication Data

US 2012/0026731 A1 Feb. 2, 2012

(30) Foreign Application Priority Data

May 24, 2010 (MY) ..... PI 2010002393

(51) Int. Cl.
*F21S 2/00* (2006.01)

(52) U.S. Cl.
USPC ..... 362/231; 362/249.02

(58) Field of Classification Search
USPC ..... 362/231, 800, 249.02
See application file for complete search history.

(56) References Cited

U.S. PATENT DOCUMENTS

| | | | | |
|---|---|---|---|---|
| 6,234,645 | B1 * | 5/2001 | Borner et al. | 362/231 |
| 6,641,284 | B2 * | 11/2003 | Stopa et al. | 362/240 |
| 6,921,182 | B2 * | 7/2005 | Anderson et al. | 362/231 |
| 7,832,896 | B2 * | 11/2010 | Saha et al. | 362/240 |
| 7,858,408 | B2 * | 12/2010 | Mueller et al. | 438/27 |
| 8,033,692 | B2 * | 10/2011 | Negley et al. | 362/341 |
| 8,042,971 | B2 * | 10/2011 | Medendorp et al. | 362/249.06 |
| 2010/0103660 | A1 * | 4/2010 | van de Ven et al. | 362/231 |

* cited by examiner

*Primary Examiner* — Peggy A. Neils
(74) *Attorney, Agent, or Firm* — Finnegan, Henderson, Farabow, Garrett & Dunner, LLP

(57) ABSTRACT

The invention relates to a light emitting diode (LED) lighting device that is comprised of a plurality of LED components and is characterized by the mixture of a primary light provided by the first and majority group of components and a secondary light provided by a second minority group of components and the components emitting the secondary light source have a viewing angle in the range of 130° to 160° and is greater than that of the primary light source. This wide angle of emission ensures that the secondary light is uniformly mixed into the primary light.

5 Claims, 3 Drawing Sheets

LED LIGHTING DEVICE WITH UNIFORM COLOR MIXING

FIELD OF INVENTION

The invention relates to a light emitting diode (LED) lighting device that is comprised of a plurality of LED components and is characterized by the mixture of a primary light provided by the first and majority group of components and a secondary light provided by a second minority group of components to produce light that has color coordinates along or close to the Plankian black body line.

PRIOR ART

Optoelectronic components such as LED are widely used in the world today especially for lighting and signaling devices. Conventional LED naturally are capable of generating saturated colours ranging from long wavelength such as red to shorter wavelength such as blue at the other end of the spectrum; depending on the semiconductor material used to manufacture the LED chip. GaP and AlInGaP material are commonly used to generate colours in the red, orange and yellow spectrum. As for blue, GaN and InGaN are used instead. These saturated colours can also be mixed in order to generate a wide range of colours. Red, green and blue can be mixed in certain proportion to generate white. This technique was described in many prior arts.

As LED application expands, there is a demand for an even wider range of colours especially colours with coordinates along or close to the Plankian black body line. One approach to fulfill this need is to employ a luminescence conversion element. Such method is described by Hohn et al. in U.S. Pat. No. 6,066,861. The prior art described the method where a luminescence conversion element is used to convert a portion of a primary wavelength emitted by a semiconductor body into radiation of a longer wavelength. This makes it possible to produce a component which radiates polychromatic light, in particular white light, with a single light-emitting semiconductor chip.

However, both methods do not produce a white light with good color rendering properties. There are numerous portions of color component that are not present in the converted output radiation especially in the higher wavelength region; ranging from 600 nm to 700 nm. As a result, one of the methods to improve color rendering is to include red LEDs as the secondary light source in the lighting device. This method is described in U.S. Pat. No. 7,213,940.

However, in many applications, it is always a challenge to design a lighting device that include red light source and yet be able to achieve a uniform color mixing between the red light source and the primary light source. This is particularly difficult in lighting devices that have a diffused shell or casing close to the light source. Examples of such devices include LED light bulbs, light tubes, light panels and etc. In such applications, a good color mixing is critical. Otherwise, spots of the secondary light source would be observable on the transparent or diffused casing of the lighting device. This is optically not desirable.

This patent will try to describe a design of lighting device that is able to resolve this issue.

DETAIL DESCRIPTION

Figure 1:
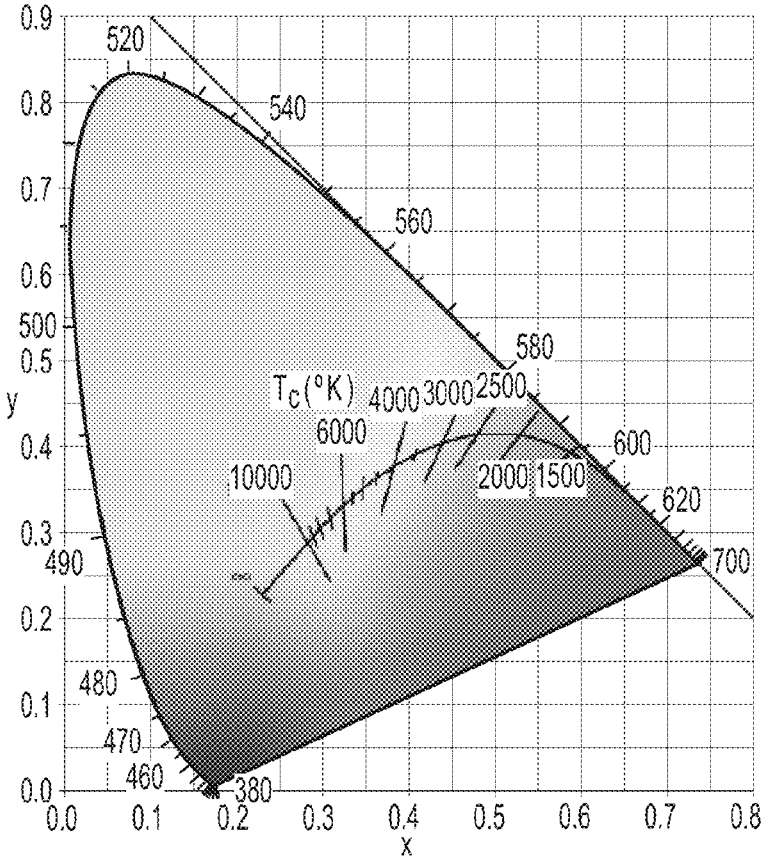
FIG. 1 is the CIE color chart depicting the Plankian black-body line.

The invention relates to a light emitting diode (LED) lighting device that is comprised of a plurality of LED components and is characterized by the mixture of a primary light provided by the first and majority group of components and a secondary light provided by a second minority group of components to produce light that has color coordinates along or close to the Plankian black body line as shown in FIG. 1.

Figure 2:
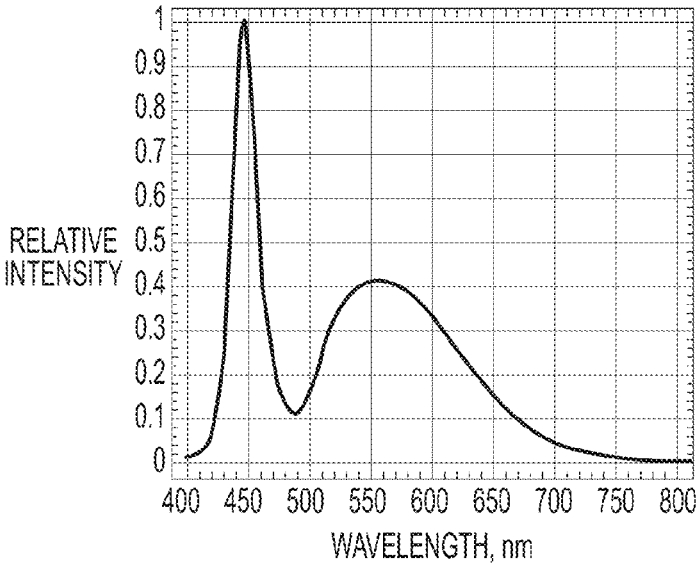
FIG. 2 is the typical color spectrum of a blue LEDs mixed with luminescence conversion element.

Blue LEOs mixed with luminescence conversion element is typically used as the primary light source. Such light source is capable to generate colors with color coordinates along or close to the Plankian black body line. A typical color spectrum of such a light source is as shown in FIG. 2. Although such light source is able to produce desirable color for most applications; the color re-producibility of such light source is normally below expectation. Color rendering index (CRI) is typically used to measure the color re-producibility of a light source. CRI is a relative measurement of how the color rendition of an illumination system compares to that of a black-body radiator. An ideal light source would have a CRI of 100. Such light source is always preferred. Daylight for example has a highest CRI of 100 while fluorescent lamps have a CRI in the range of 70-80. Blue LEDs mixed with luminescence conversion element on the other hand will only exhibit CRI in the range of 60-75. For typical illumination applications, a CRI of 80-85 is required to ensure comfort to the human sight and optimum color re-producibility.

In order to increase the CRI of LED lighting devices, secondary light source with long wavelength such as red LED in the range of 610-630 nm are added to the lighting device. Typically the minority secondary red light source will constitute approximately 25-40% of the total light output of the LED lighting device. With the introduction of such secondary light source, the CRI of the lighting device can be increased to the range of 80-85 and hence fulfilling the requirement for general illumination.

However, in many applications, it is always a challenge to design a lighting device that include red light source and yet be able to achieve a uniform color mixing between the red light source and the primary light source. This is particularly difficult in lighting devices that have a transparent or diffused shell or casing close to the light source. Examples of such devices include LED light bulbs, light tubes, light panels and etc. In such applications, a good color mixing is critical. Otherwise, spots of the secondary light source would be observable on the diffused casing of the lighting device. This is optically not desirable.

Figure 3:
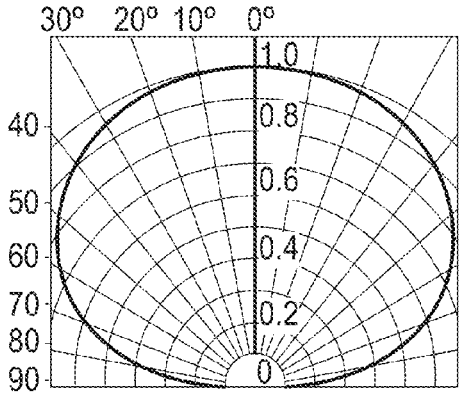
FIG. 3 is a typical diagram of the radiation pattern of the secondary light source with a large viewing angle.
Figure 4:
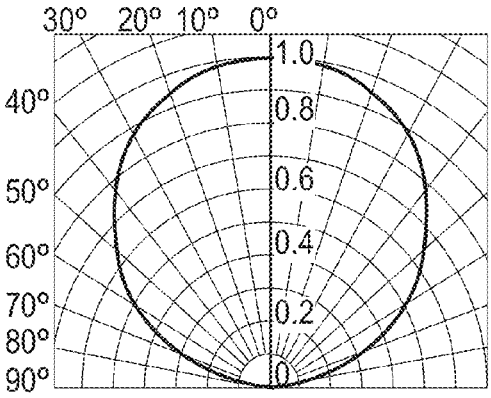
FIG. 4 is a typical diagram of the radiation pattern of the primary light source with a small viewing angle.
Figure 5:
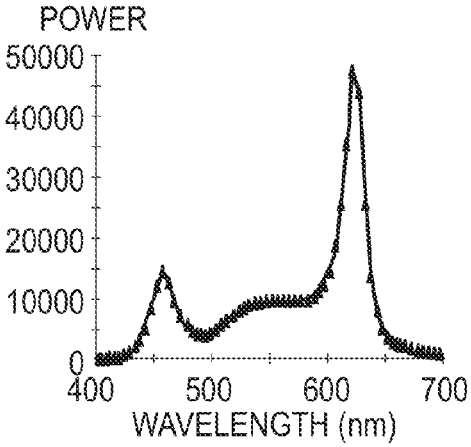
FIG. 5 illustrates a typical color spectrum of the mixed light from the lighting device.

In accordance to the present invention, a good color mixing can be achieved by deploying a combination of secondary light source that has a viewing angle that is much larger compared to the primary light source. A light emitting diode (LED) lighting device with good color mixing is one which is comprised of a plurality of LED components and is characterized by the mixture of a primary light source provided by the first and majority group of components and a secondary light source provided by a second minority group of components and the components emitting the secondary light source have a viewing angle in the range of 130° to 160° and is greater than that of the primary light source. The viewing angle of an optical component is defined as the angle where the light intensity of the light source will decrease to 50% from its peak in the forward direct axial direction. This wide angle of emission ensures that the secondary light is uniformly mixed into the primary light. A typical diagram of the viewing angle of such a secondary light source is as depicted by FIG. 3. On the other hand the viewing angle of the primary light sources is normally smaller and is in the range of 100° to 120°. A typical radiation pattern of such a light source is depicted in FIG. 4.

The primary light source is typically comprised of blue LEDs mixed with luminescence conversion element while the secondary light source comprised of LEDs with long wavelength in the range of 610-630 nm. The primary and secondary light sources are typically mixed in the proportion where the secondary light source constitutes approximately 25-40% of the total light output. FIG. E illustrates a typical color spectrum of the mixed light from the lighting device. In this proportion, the CRI of the lighting device would approximately be in the range of 75-90. Such CRI is desirable for general illumination.

Figure 6:
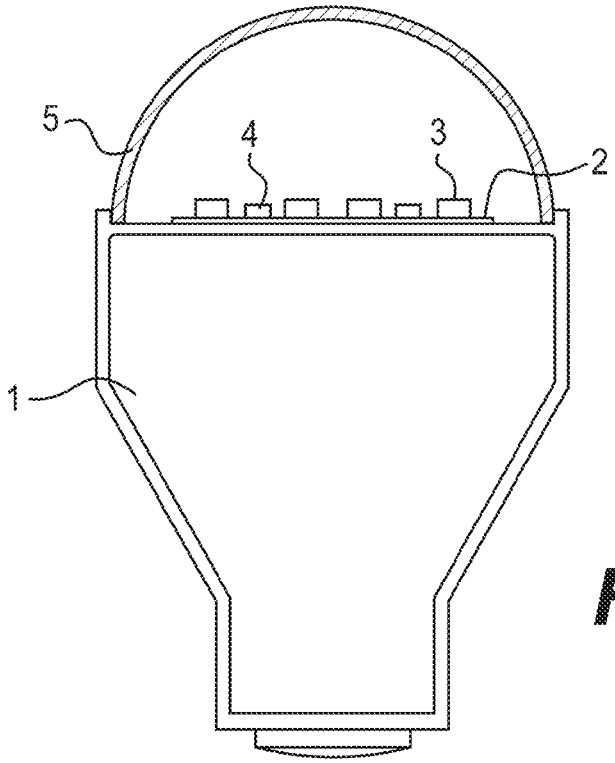
FIG. 6 is the schematic view of the first exemplary embodiment of a LED light bulb according to the invention.
Figure 7:
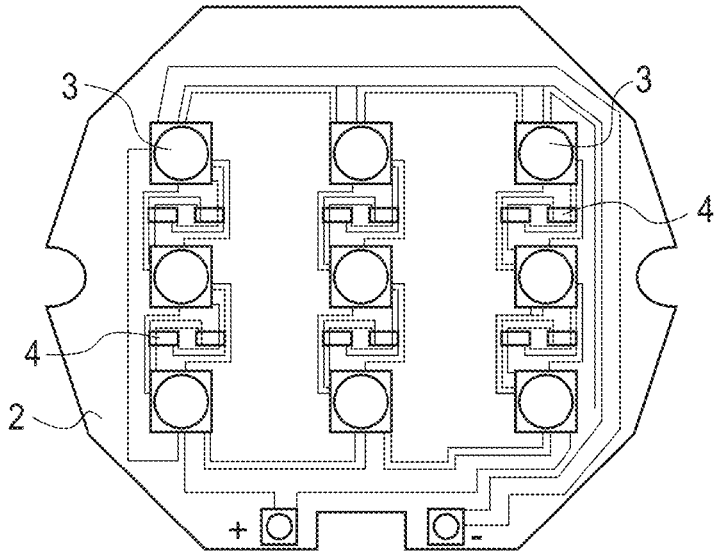
FIG. 7 is the schematic view of the first exemplary embodiment of the components and PCB according to the invention

In an embodiment of the present invention, FIG. 6 is a schematic view of the first exemplary embodiment of a LED light bulb according to the invention. The LED light bulb is made up of an external casing (1). This casing can be made out of metal such as aluminium or cast iron. It can also be molded out of conventional plastic such as ABS. The light source is made out of a PCB (2). FIG. 7 illustrates a typical lay-out of the PCB where the light sources are mounted. A group of blue LEDs mixed with luminescence conversion element (3) is typically used as the primary light source. This group of light source will typically generate a high level of light output in the range of 400 lumen to 1000 lumen. A multiple of this light source is arranged in an electrical circuit arrangement so that electrical connection can be made. In the matrix of primary light source, red LEDs are added as secondary light source (4) into the electrical circuit arrangement so that the color rendering index (CRI) of the light can be improved. The secondary light source will supply typically about 25% to 40% of the primary light source. In this proportion, the CRI of the lighting device would approximately in the range of 75-90. The red LEDs are specially selected to that the optical viewing angle of each of the red LED is in the range of 130° to 160°. The typical optical viewing angle of the blue LEDs mixed with luminescence conversion element (3) is typically 100° to 120°. The relatively wider viewing angle of the secondary light source ensures that good mixing is achieved. A uniform color of the combined light sources could be observed on the transparent or translucent casing (5) of the light bulb. If the color mixing is poor, spots of red hue can be seen on the transparent or translucent casing (5) and this will be undesirable.

The invention claimed is:

1. A light emitting diode (LED) lighting device which is comprised of a plurality of LED components and is characterized by the mixture of a primary light source provided by the first and majority group of components and a secondary light source provided by a second minority group of components and the components emitting the secondary light source have a viewing angle in the range of 130° to 160° and the viewing angle of the secondary light source is greater than the viewing angle of the primary light source.

2. A lighting device as stated in claim 1, where the primary light source are blue LEDs mixed with luminescence conversion element and have a viewing angle in the range of 100° to 120°.

3. A lighting device as stated in claim 1, where the secondary light source comprised of LEDs with long wavelength in the range of 610-630 nm.

4. A lighting device as stated in claim 1, where the primary and secondary light source are typically mixed in the proportion where the secondary light source constitute approximately 25-40% of the total light output.

5. A lighting device as stated in claim 1, where the color rendering index is in the range of 75-90.

* * * * *